US009227125B2

(12) United States Patent
Le

(10) Patent No.: US 9,227,125 B2
(45) Date of Patent: Jan. 5, 2016

(54) BASKETBALL RETURN APPARATUS

(71) Applicant: Anthony Y. Le, West Covina, CA (US)

(72) Inventor: Anthony Y. Le, West Covina, CA (US)

( * ) Notice: Subject to any disclaimer, the term of this patent is extended or adjusted under 35 U.S.C. 154(b) by 43 days.

(21) Appl. No.: 14/215,620

(22) Filed: Mar. 17, 2014

(65) Prior Publication Data

US 2015/0258404 A1 Sep. 17, 2015

(51) Int. Cl.

*A63B 69/00* (2006.01)
*A63B 71/06* (2006.01)
*A63B 63/00* (2006.01)

(52) U.S. Cl.

CPC ..... *A63B 69/0071* (2013.01); *A63B 71/0669* (2013.01); *A63B 2063/001* (2013.01); *A63B 2220/17* (2013.01); *A63B 2220/833* (2013.01)

(58) Field of Classification Search

CPC ..... A63B 69/00; A63B 71/06
USPC ..... 473/434, 435, 433, 447; D21/701
See application file for complete search history.

(56) References Cited

U.S. PATENT DOCUMENTS

| | | | | | |
|---|---|---|---|---|---|
| 4,858,920 | A * | 8/1989 | Best | 473/480 |
| 4,956,775 | A * | 9/1990 | Klamer et al. | 473/480 |
| 5,141,224 | A | 8/1992 | Nolde et al. | |
| 5,165,680 | A * | 11/1992 | Cass | 473/433 |
| 5,171,009 | A * | 12/1992 | Filewich et al. | 473/433 |
| 5,184,814 | A | 2/1993 | Manning | |
| 5,409,211 | A | 4/1995 | Adamek | |
| 5,830,088 | A * | 11/1998 | Franklin de Abreu | 473/433 |
| 6,074,313 | A | 6/2000 | Pearson | |
| 6,389,368 | B1 * | 5/2002 | Hampton | 702/179 |
| 7,530,909 | B2 | 5/2009 | Thomas et al. | |
| 7,597,635 | B2 * | 10/2009 | Davies | 473/447 |
| 7,841,957 | B1 | 11/2010 | Wares | |
| 8,012,046 | B2 | 9/2011 | Campbell et al. | |
| 8,147,356 | B2 | 4/2012 | Campbell et al. | |
| 2009/0203472 | A1 * | 8/2009 | Snyder | 473/433 |
| 2010/0113189 | A1 * | 5/2010 | Blair | 473/433 |

OTHER PUBLICATIONS

"Lifetime Hoop Chute Basketball Ball Return Training Aid" www.amazon.com/lifetime-chute-basketball-return-training/dp/B0000AE6H5.

* cited by examiner

*Primary Examiner* — Gene Kim
*Assistant Examiner* — M Chambers
(74) *Attorney, Agent, or Firm* — Greenberg Traurig, LLP

(57) ABSTRACT

A basketball return apparatus comprising a frame, an attachment section, one or more flaps, and a basketball return mechanism. The attachment section, which is no smaller than a basketball hoop, is connected to the frame and configured to attach to a basketball hoop. The attachment section includes one or more sensors that detect and record the number of basketball shots passing through the basketball hoop. The one or more flaps are connected to the attachment section, and are configured to tilt downwardly and inwardly towards the attachment section. The one or more flaps, which are connected to and positioned around the attachment section, are flexible to absorb the momentum of an incoming basketball and are capable of directing the basketball towards the attachment section. The one or more flaps include one or more sensors that detect and record the data generated by the contacts caused by incoming basketballs contacting the one or more flaps. Based on the number recorded by the one or more sensors at the attachment section and the data recorded by the one or more sensors at the one or more flaps, the shooting statistics, such as the number of basketball shots attempted, made, or missed, are thereby obtained. The basketball return mechanism, comprising a sloped chute, is positioned below the basketball hoop such that a basketball passing through the basketball hoop is directed to a desired direction as directed by the sloped chute.

6 Claims, 5 Drawing Sheets

FIG. 5
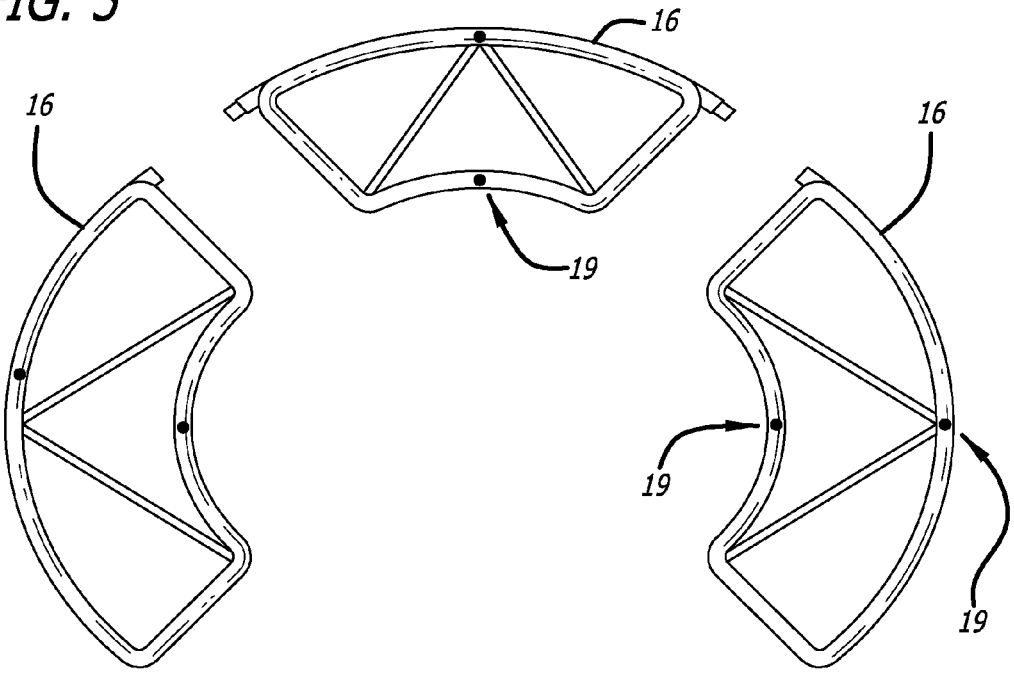
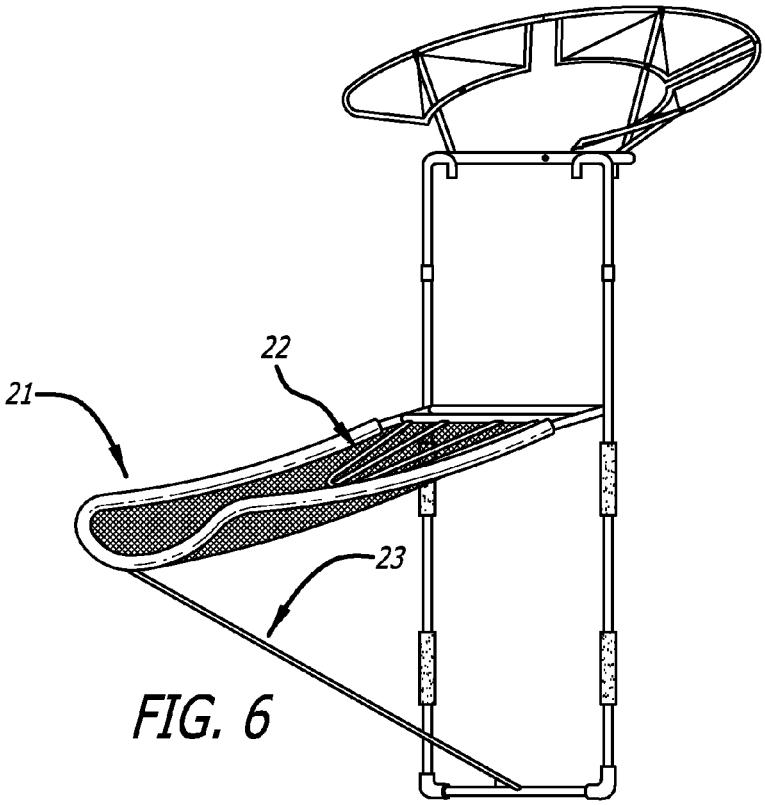
FIG. 6

BASKETBALL RETURN APPARATUS

RELATED APPLICATION

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not Applicable.

THE NAMES OF THE PARTIES TO A JOINT RESEARCH AGREEMENT

Not applicable.

BACKGROUND OF THE INVENTION

1. Field

The invention relates to a basketball return apparatus that can be attached to a basketball hoop at any angle relative to the basketball backboard to which the basketball hoop is attached, and can capture both made and missed basketball shots and return the basketball towards a desired direction. More particularly, the invention relates to a basketball return apparatus that a person can easily attach to and detach from a basketball hoop without requiring the person climb up to the basketball hoop or lower the basketball hoop.

2. Description of Related Art Including Information Disclosed Under 37 C.F.R. 1.97 and 1.98

Basketball shooting is an important fundamental skill to basketball players. Basketball players often spend substantial amount of time practicing basketball shooting. Basketball players often practice basketball shooting by taking repetitive shots from one location on a basketball court, and then repeat the same process at different locations on the basketball court. In doing so, basketball players can improve their ability to make basketball shots from different angles or distances on the basketball court. However, unless there is another person retrieving basketball rebounds for a basketball player, the basketball player must spend time retrieving basketball rebounds for himself or herself, which results in less efficient shooting practice as the basketball player spends less time on actual shooting practice. Moreover, the constant interruption to retrieve basketball rebounds adversely affects the basketball player's shooting rhythm that he or she tries to build up through the shooting practice.

As most basketball shooting practices involve taking numerous basketball shots over a period of time, it is difficult for a basketball player to keep track of his or her shooting statistics (such as the numbers of basketball shots attempted, made, and missed) while focusing on perfecting his or her basketball shooting skill. There is therefore a need to provide a mechanism that can automatically record shooting statistics for a basketball player.

Several basketball return devices had been introduced in recent years. However, those devices have drawbacks. U.S. Pat. No. 5,165,680 discloses a basketball practice device consists of a rigid structure that deflects rather than collects poorly shot basketball. The device disclosed therein is securely clamped to a basketball hoop, which would require a person climbing up to the basketball hoop or lowering the basketball hoop in order to dismount the device from the basketball hoop. The mounting or dismounting process is cumbersome, and often times unsafe. U.S. Pat. No. 5,409,211 discloses a basketball return device that is mounted to a basketball hoop or the net hanging below the basketball hoop. This device, however, cannot collect missed basketball shots. U.S. Pat. No. 8,012,046 discloses a bulky basketball return device. This device includes a large netting structure that requires a basketball player shoot basketballs with trajectory high enough to pass over the netting structure. Further, the netting structure prohibits basketball shots from close range. Another drawback of the netting structure is that it obstructs (at least partially) the basketball player's view to the basketball hoop. None of the devices described above has the capability of providing shooting statistics to a basketball player.

BRIEF SUMMARY OF THE INVENTION

It is an object of this invention to provide a basketball return apparatus that can be easily attached to and detached from a basketball hoop by one person without having to climb up to the basketball hoop or lowering the basketball hoop in order to attach or detach the basketball return apparatus.

It is a further object of this invention to provide such an apparatus that can be easily disassembled or reduced in size.

It is a further object of this invention to provide such an apparatus that adapted to be attached to a basketball hoop at different angles relative to the basketball backboard to which the basketball hoop is attached.

It is a further object of this invention to provide such an apparatus that, without any netting structure, catches both made and missed shots, and returns the basketballs towards a desired direction.

It is a further object of this invention to provide such an apparatus that is flexible to minimize missed shots bouncing off of the system.

It is a further object of this invention to provide such an apparatus that provides shooting statistics, such as the numbers of shots attempted, made, or missed, to a basketball shooter.

These and other objects are preferably accomplished by providing a basketball return apparatus comprising a frame, an attachment section, one or more flaps to collect missed basketball shots, and a basketball return mechanism. The attachment section, which is no smaller than a basketball hoop, is connected to the frame and configured to be attached to a basketball hoop. Preferably, the attachment section is of circular or substantially semi-circular shape. The attachment section includes one or more sensors that detect and record the number of basketball shots passing through the basketball hoop. The one or more flaps are connected to the attachment section, and are configured to tilt downwardly and inwardly towards the attachment section. The one or more flaps, which are connected to and positioned around the attachment section, are flexible to absorb the momentum of an incoming basketball and are capable of directing the basketball towards the attachment section. The one or more flaps include one or more sensors that detect and record the data generated by the contacts caused by incoming basketballs contacting the flaps. Such data might include the number of contacts, the momentum of an incoming basketball, and the extent of flex of the flaps caused by the momentum of an incoming basketball. Based on the number recorded by the one or more sensors at the attachment section and that recorded by the one or more sensors at the flaps, the shooting statistics, such as the number of basketball shots attempted, made, or missed, are thereby obtained. The basketball return mechanism, comprising a sloped chute, is connected to the frame and positioned below the basketball hoop to which the attachment section is attached such that a basketball passing through the basketball hoop is directed towards a desired direction as directed by the chute. Optionally, the basketball return apparatus may include additional structures, such as drop-down pins around the attachment section, to minimize potential movement of the basketball return apparatus when it is attached to a basketball hoop.

Preferably, the basketball return apparatus can be easily disassembled or reduced in size by disconnecting and/or rearranging various parts of the apparatus.

BRIEF DESCRIPTION OF THE SEVERAL VIEWS OF THE DRAWINGS

The above-mentioned features and objects of the present disclosure will become more apparent with reference to the following description taken in conjunction with the accompanying drawings wherein like reference numerals denote like elements and in which:

FIG. 5 is a top view of the flaps as described in FIG. 1 in a disassembled state.

FIG. 6 is a perspective view that shows the back portion of the chute folded towards the font portion of the chute.

DETAILED DESCRIPTION OF THE INVENTION

Figure 1:
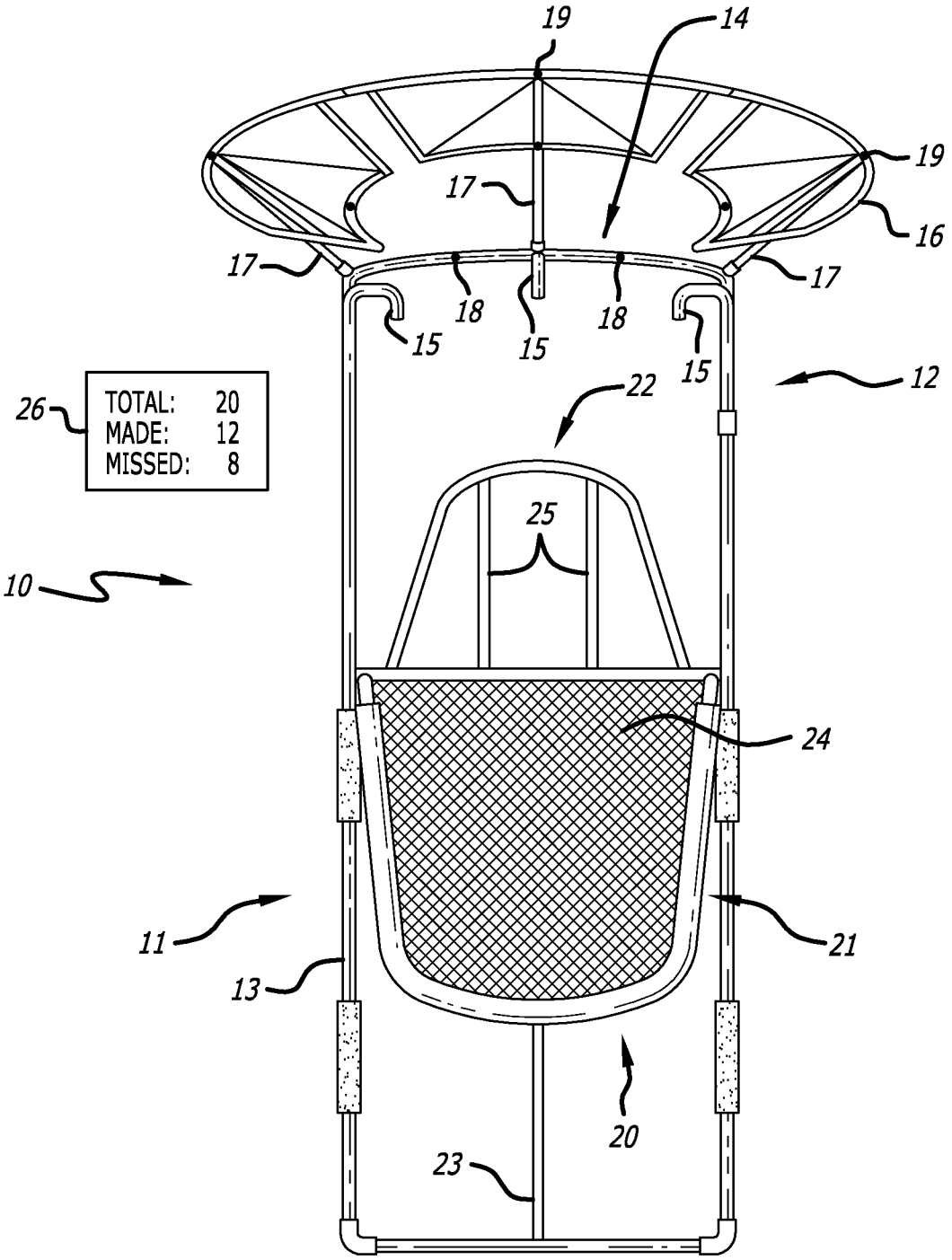
FIG. 1 is a front perspective view of a basketball return apparatus according to one embodiment of the present invention.

For illustrative purpose, the principles of the present invention are described by referring to an exemplary embodiment thereof. Referring now to FIG. 1 of the drawing, a basketball return apparatus 10 is shown to have a frame 11 comprising an upper portion 12 and a lower portion 13. An attachment section 14 (which is in substantially semi-circular shape) that is connected to the upper portion 12 of the frame 11. The attachment section includes a plurality of angular pieces 15 for the purpose of attaching the attachment section to a basketball hoop. Three flaps 16 are connected together and to the attachment section 14 through supporting rods 17. The attachment section includes one or more sensors 18 that detect and record the number of basketball shots passing through the semi-circular section. The flaps 16 tilt downwardly and inwardly towards the attachment section 14. The flaps 16 are positioned around the attachment section 14. The flaps 16 are flexible to absorb the momentum of an incoming basketball and are capable of directing the basketball towards the attachment section. The flexibility of the flaps can be accomplished by selecting material (such as reinforced fiberglass or PVC) that is strong enough to withstand the momentum of an incoming basketball shot, yet flexible enough to absorb such momentum in order to minimize the chance of the basketball bouncing away from the basketball return apparatus. The flaps include one or more sensors 19 that detect and record the data generated by the contacts caused by incoming basketballs contacting the flaps. Such data might include the number of contacts, the momentum of an incoming basketball, and the extent of flex of the flaps caused by the momentum of an incoming basketball. Based on the number recorded by the sensors 18 at the attachment section and that recorded by the sensors 19 at the flaps, the shooting statistics, such as the number of basketball shots attempted, made, or missed, are thereby obtained.

As shown in FIG. 1, a basketball return mechanism includes a chute 20 that has front portion 21 and a back portion 22. An optional supporting rod 23 may be used to connect the front portion 21 to the frame 11 to provide further support to the chute. The joint location of the front portion and back portion is positioned approximately below the attachment section 14. The back portion 22 tilts upwardly and away from the attachment section; and the front portion 21 tilts downwardly and away from the attachment section. When a basketball passes through the attachment section (which is attached to a basketball hoop), the basketball will fall onto the chute, and roll towards a direction as directed by the chute.

Optionally, as shown in FIG. 1, the front portion 21 has a netting structure 24 to catch an incoming basketball; and the back portion has two bars 25 that guide an incoming basketball rolling towards the direction pointed by the chute. Other variations may be used to perform the same function. Additionally, a display 26, which is configured to display shooting statistics, such as the numbers of shots attempted, made, and/or missed, is connected to the basketball return apparatus via wire or wireless means.

Figure 2:
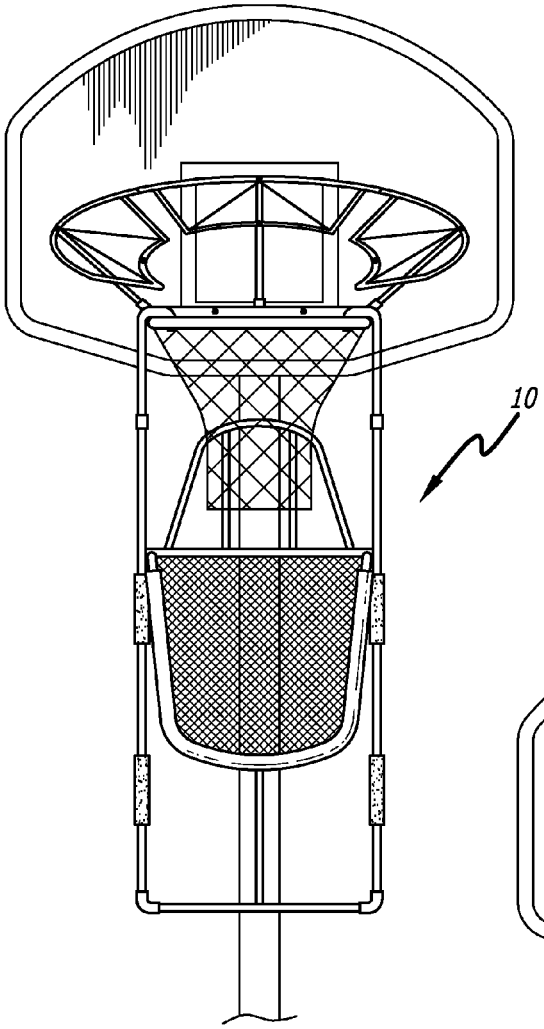
FIG. 2 is a front perspective view of the basketball return apparatus that is attached to a basketball hoop at approximately the right angle (90-degree) relative to the basketball backboard to which the basketball hoop is attached.
Figure 3:
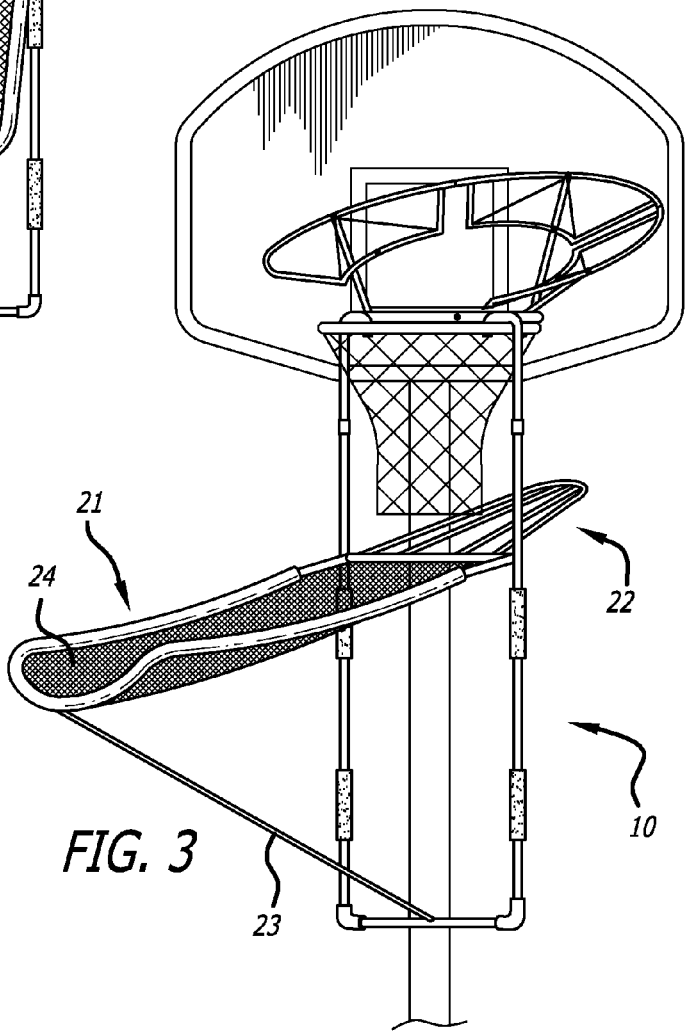
FIG. 3 is a perspective view of the basketball return apparatus that is attached to a basketball hoop at an acute angle relative to the basketball backboard to which the basketball hoop is attached

FIG. 2 shows that the basketball return apparatus 10 shown in FIG. 1 attaches to a basketball hoop at approximately the right angle (90-degree) relative to the basketball backboard to which the basketball hoop is attached FIG. 3 shows that the basketball return apparatus 10 shown in FIG. 1 attaches to a basketball hoop at approximately an acute angle relative to the basketball backboard to which the basketball hoop is attached.

Figure 4:
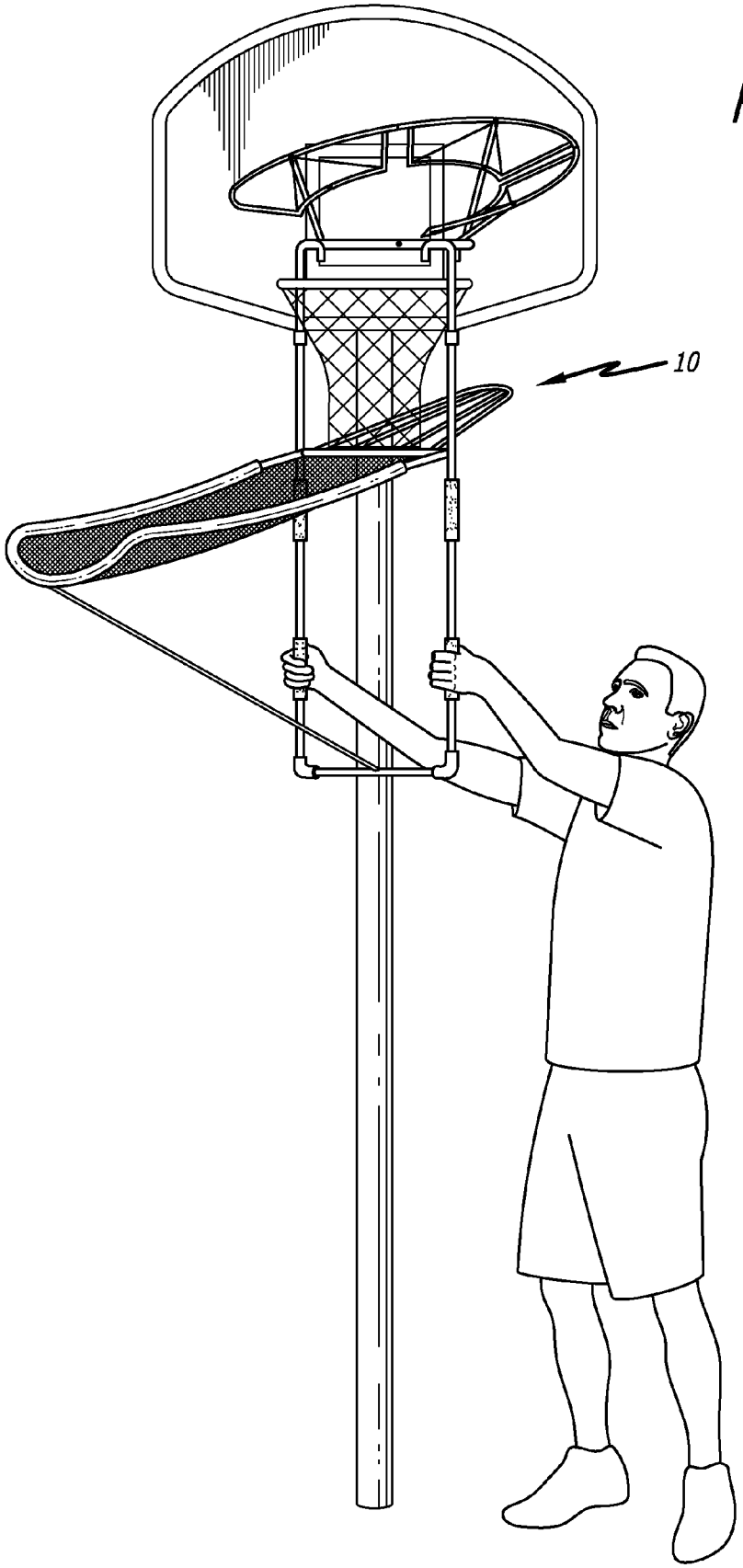
FIG. 4 is perspective view of detaching the basketball return apparatus from the basketball hoop by a person.

FIG. 4 shows that the basketball return apparatus 10 shown in FIG. 1 can be easily detached from a basketball hoop by a simply holding the lower portion 13 of the frame 11 and lifting the basketball return apparatus 10 away from the basketball hoop. As shown if FIG. 4, there is no need for a person to climb up or lower the basketball hoop in order to detach the basketball return apparatus 10 from the basketball hoop.

FIG. 5 depicts the flaps described in FIG. 1 in a disassembled state.

FIG. 6 shows the back portion 22 of the chute as described in FIG. 1 being folded towards the font portion 21 of the chute.

Figure 7:
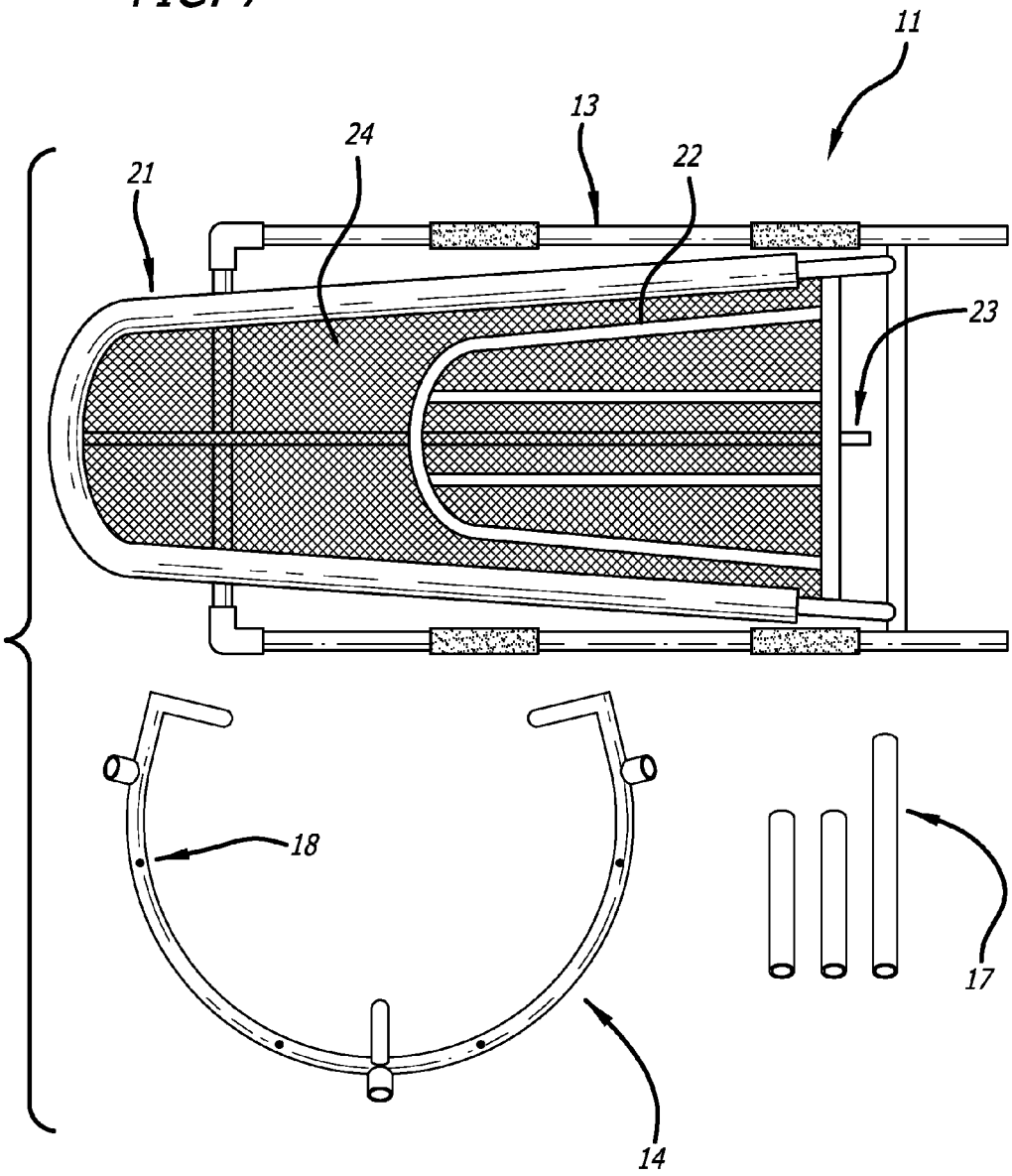
FIG. 7 is a perspective view that shows the basketball return apparatus in a disassembled state.

FIG. 7 shows the disassembled basketball return apparatus 10. As shown in FIG. 7, the front portion 21 of the chute is folded towards the frame 11 with the supporting rod 23 being detached from the frame 11. The back portion 22 of the chute is folded toward the front portion 21. The upper portion 12 of the frame 11 is removed. Optionally, the upper portion 12 (as shown in FIG. 1) can be inserted into the lower portion 13 or vice versa. The attachment section 14 is disconnected from the frame 11. Supporting rods 17 for the flaps 16 can also be disconnected from the attachment section 14. The flaps 16 might also be disassembled as shown in FIG. 5. It is convenient to transport or place in storage with the disassembled basketball return apparatus 10.

Optionally, the attachment section 14 can be pivotally connected to the upper portion 12 (e.g. by hinges) so that the attachment section 14 and the upper portion 12 can be folded together instead of being disconnected completely. Similarly, the supporting rods 17 may also be pivotally connected (e.g. by hinges) to the attachment section 14 by hinges.

Although a particular embodiment of the invention is disclosed, variations thereof might occur to an artisan and the scope of the invention should only be limited by the scope of the appended claims.

The invention claimed is:

1. A basketball return apparatus comprising:

a frame, an attachment section, one or more flaps, and a basketball return mechanism;

the frame comprising an upper portion and a lower portion;

the attachment section, which is no smaller than a basketball hoop, is connected to the upper portion of the frame, and is configured to attach to a basketball hoop at any angle relative to the basketball backboard to which the basketball hoop is attached;

the one or more flaps are connected to the attachment section and positioned around the attachment section;

the one or more flaps are configured to tilt downwardly and inwardly towards the attachment section;

the one or more flaps are flexible to catch and absorb the momentum of an incoming basketball and direct the basketball towards the attachment section;

wherein the one or more flaps are configured to be disconnected from the attachment section; and the basketball return mechanism which is attached to the frame, comprising a chute, which slops downwardly and away from the attachment section and is positioned below the basketball hoop, that directs a basketball passing through the basketball hoop towards a desired direction and wherein the basketball return apparatus is configured to be attached to or detached from a basketball hoop by one person standing on the ground and without altering the height of the basketball hoop.

2. The basketball return apparatus of claim 1 wherein the chute of the basketball return mechanism further comprising:

a front portion having a first end and a second end; and a back portion having a first end and a second end;

the first end of the front portion is connected to the first end of the back portion;

the first end of the front portion and the first end of the back portion are positioned below the basketball hoop;

the front portion tilts downwardly and away from the basketball hoop from the first end of the front portion towards the second end of the front portion; and the back portion tilts upwardly and away from the basketball hoop from the first end of the back portion towards the second end of the back portion.

3. The basketball return apparatus of claim 2 wherein the length of the chute is configured to be reduced by folding the back portion of the chute towards the front portion of the chute.

4. The basketball return apparatus of claim 1 wherein the attachment section is pivotally connected to the upper portion of the frame.

5. The basketball return apparatus of claim 1 wherein the frame's length is configured to be telescopically shortened.

6. The basketball return apparatus of claim 1 wherein the frame's length is configured to be shortened by disconnecting the lower portion from the upper portion.

* * * * *